US007752856B2

(12) United States Patent
Senba et al.

(10) Patent No.: US 7,752,856 B2
(45) Date of Patent: Jul. 13, 2010

(54) MONITORING AND CONTROL SYSTEM FOR AIR CONDITIONER

(75) Inventors: Kazuhito Senba, Kusatsu (JP); Tetsuyuki Kondou, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 675 days.

(21) Appl. No.: 10/586,605

(22) PCT Filed: Feb. 24, 2005

(86) PCT No.: PCT/JP2005/003000

§ 371 (c)(1),
(2), (4) Date: Jul. 19, 2006

(87) PCT Pub. No.: WO2005/088203

PCT Pub. Date: Sep. 22, 2005

(65) Prior Publication Data

US 2008/0236177 A1 Oct. 2, 2008

(30) Foreign Application Priority Data

Feb. 24, 2004 (JP) ..... 2004-047420

(51) Int. Cl.
*G05D 23/32* (2006.01)
*G01M 1/38* (2006.01)

(52) U.S. Cl. ..... 62/157; 700/275; 700/276; 700/299; 700/300

(58) Field of Classification Search ..... 62/157; 700/275, 276, 299, 300
See application file for complete search history.

(56) References Cited

U.S. PATENT DOCUMENTS

| | | | | |
|---|---|---|---|---|
| 6,389,331 | B1 * | 5/2002 | Jensen et al. | 700/275 |
| 2004/0117069 | A1 * | 6/2004 | Yoon et al. | 700/276 |

FOREIGN PATENT DOCUMENTS

| | | | |
|---|---|---|---|
| JP | 2002-149234 | A | 5/2002 |
| JP | 2002-156143 | A | 5/2002 |
| JP | 2002-188840 | A | 7/2002 |
| JP | 2002-315066 | A | 10/2002 |

* cited by examiner

*Primary Examiner*—Frantz F. Jules
*Assistant Examiner*—Travis Ruby
(74) *Attorney, Agent, or Firm*—Global IP Counselors

(57) ABSTRACT

An air conditioning monitoring and control system includes an air conditioner, a first air conditioning monitoring and control device and a second air conditioning monitoring and control device. The first air conditioning monitoring and control device communicates with the air conditioner via a first communication line. The first air conditioning monitoring and control device includes a first monitoring and control function and a second monitoring and control function. The second air conditioning monitoring and control device communicates with the air conditioner via a second communication line. The second air conditioning monitoring and control device includes the first monitoring and control function and a third monitoring and control function.

6 Claims, 4 Drawing Sheets

*Fig. 2*

| Function | | Single Controller System | | Multiple Controller System | |
|---|---|---|---|---|---|
| | | Manufacture-private protocol air conditioning controller | Open protocol air conditioning controller | Manufacture-private protocol air conditioning controller | Open protocol air conditioning controller |
| Monitoring related functions | Status monitoring | ○ | ○ | ○ | ○ |
| | Monitoring prohibition/permission setting of operation by remote controller | ○ | ○ | ○ | × |
| | Monitoring forced thermostat OFF state | — | ○ | — | ○ |
| | Monitoring start-up/shutdown failure | ○ | ○ | ○ | ○ |
| | Monitoring continuous operation period | ○ | — | ○ | — |
| | Monitoring conflicting status and warning | ○ | — | ○ | — |
| | Monitoring upper and lower measurement limits | ○ | ○ | ○ | ○ |
| Operation related functions | Starting up/shutting down and changing set values for each device individually | ○ | ○ | ○ | ○ |
| | Prohibiting/permitting operation by remote controller | ○ | ○ | ○ | × |
| | Forcibly setting thermostat OFF | — | ○ | — | × |
| | Registering device for maintenance | ○ | ○ | ○ | ○ |

○: Function is included, —: function is not included, ×: function is disabled.

*Fig. 3*

| Function | | Single Controller System | | Multiple Controller System | |
|---|---|---|---|---|---|
| | | Manufacture-private protocol air conditioning controller | Open protocol air conditioning controller | Manufacture-private protocol air conditioning controller | Open protocol air conditioning controller |
| Control related functions | Schedule control function | ○ | ○ | ○ | × |
| | | | | × | ○ |
| | Gang control | ○ | ○ | ○ | × |
| | | | | × | ○ |
| | Handling power failure and restoration | ○ | ○ | ○ | × |
| | | | | × | ○ |
| | Forcible shutdown function | ○ | ○ | ○ | × |
| | | | | × | ○ |
| | Prohibiting integrated operation from low-order integrated device | ○ | ○ | × | × |
| | Energy saving control | ○ | — | ○ | — |
| | Demand control function | ○ | — | ○ | — |
| Data management functions | Counting total operation hours | ○ | ○ | ○ | ○ |
| | Counting total number of start-up/shutdown events | ○ | ○ | ○ | ○ |
| | Preparing daily, monthly, annual reports | ○ | — | ○ | — |
| | Trend report function | ○ | ○ | ○ | ○ |
| | Calculating energy consumption cost based on power allocation | ○ | ○ | ○ | × |
| | | | | × | ○ |
| | NSC AIRNET | ○ | ○ | ○ | × |
| | Predicting local malfunction | ○ | — | ○ | — |

○: Function is included, —: function is not included, ×: function is disabled.

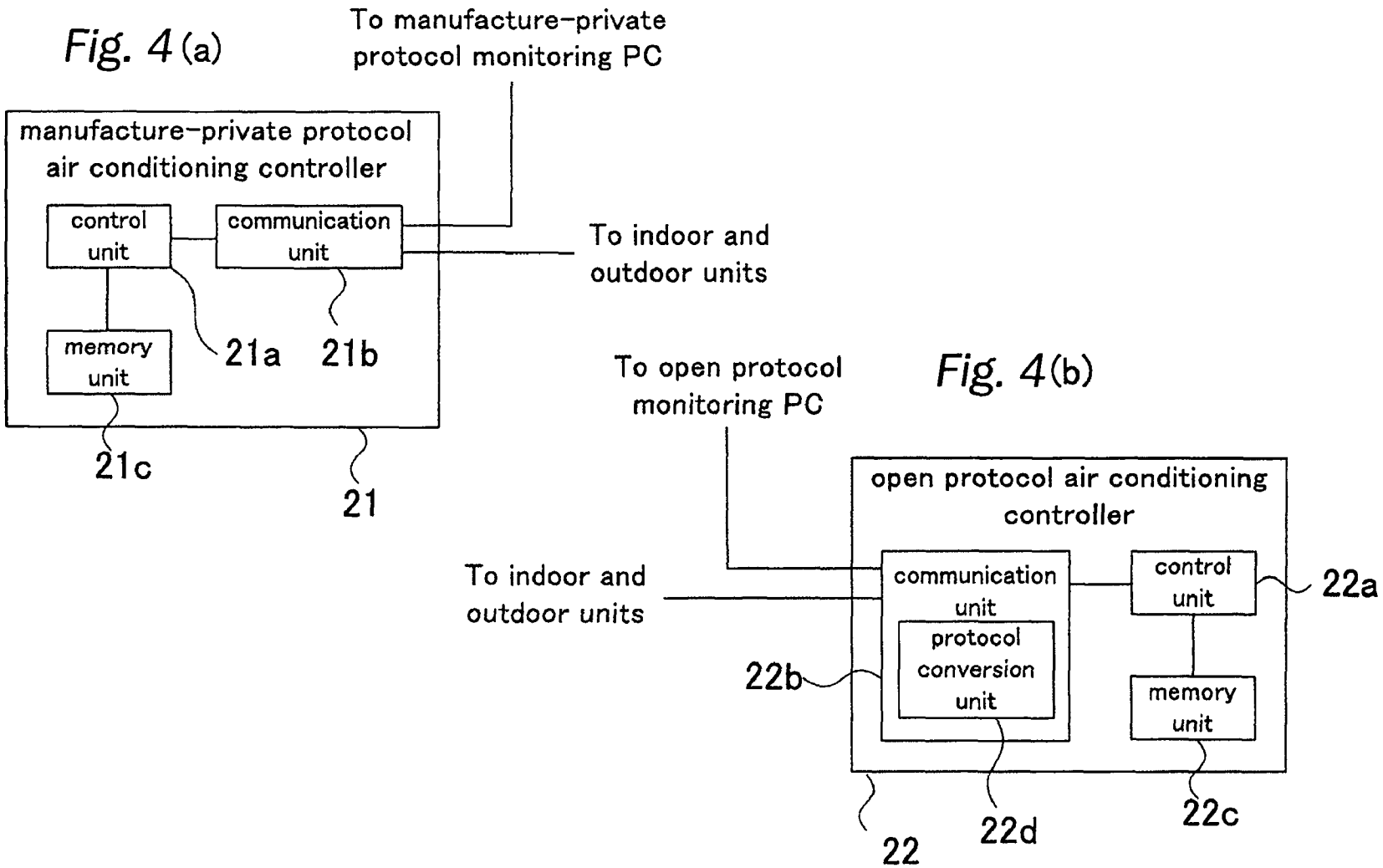
Fig. 4(a)
manufacture-private protocol air conditioning controller
control unit
memory unit
communication unit
21a
21b
21c
21
To manufacture-private protocol monitoring PC
To indoor and outdoor units
Fig. 4(b)
open protocol air conditioning controller
control unit
memory unit
communication unit
protocol conversion unit
22a
22b
22c
22d
22
To open protocol monitoring PC
To indoor and outdoor units

MONITORING AND CONTROL SYSTEM FOR AIR CONDITIONER

CROSS-REFERENCE TO RELATED APPLICATIONS

This U.S. National stage application claims priority under 35 U.S.C. §119(a) to Japanese Patent Application No. 2004-047420, filed in Japan on Feb. 24, 2004, the entire contents of which are hereby incorporated herein by reference.

TECHNICAL FIELD

The present invention relates to an air conditioning monitoring and control system that monitors and controls an air conditioner.

BACKGROUND ART

In recent years, an open protocol has been used for communication between an air conditioner and an air conditioning monitoring and control device in building monitoring systems (for example, see Japanese Patent Publication No. 2002-156143). If this type of open protocol will be used more extensively in the future, even when air conditioners manufactured by several manufacturers are installed in the same building, it will be possible to operate these air conditioners as one system, which consequently increases user convenience.

SUMMARY OF THE INVENTION

Problem to be Solved by the Invention

However, at present, common data model patterns of air conditioners are limited, and therefore it is extremely difficult to incorporate long-accumulated manufacturer-private monitoring and control technologies into current building monitoring systems. Consequently, at present, an open protocol is only used for basic functions such as monitoring and control of start-up/shutdown of air conditioners. It is therefore an object of the present invention to provide an air conditioning monitoring and control system which is capable of performing manufacturer-private and precise monitoring and control of air conditioners while enabling communication between air conditioners and air conditioning monitoring and control devices using an open protocol.

Means of Achieving the Object

An air conditioning monitoring and control system according to a first aspect of the present invention comprises air conditioners, a first air conditioning monitoring and control device, and a second air conditioning monitoring and control device. The first air conditioning monitoring and control device communicates with the air conditioners via a first communication line. In addition, this first air conditioning monitoring and control device includes first monitoring and control means and second monitoring and control means. The first monitoring and control means and the second monitoring and control means monitor and/or control the air conditioners. The second air conditioning monitoring and control device communicates with the air conditioners via a second communication line. In addition, this second air conditioning monitoring and control device includes the first monitoring and control means and third monitoring and control means. The first monitoring and control means and the third monitoring and control means monitor and/or control the air conditioners.

Here, the first air conditioning monitoring and control device includes the first monitoring and control means and the second monitoring and control means. In addition, the second air conditioning monitoring and control device includes the first monitoring and control means and the third monitoring and control means. Here, if the first air conditioning monitoring and control device is an air conditioning monitoring and control device compliant with a manufacturer-private protocol and if the second air conditioning monitoring and control device is an air conditioning monitoring and control device compliant with an open protocol, the first monitoring and control means will be the common monitoring and control means between the first air conditioning monitoring and control device and the second air conditioning monitoring and control device, the second monitoring and control means will be the monitoring and control means that is compliant with manufacturer-private protocol, and the third monitoring and control means will be the monitoring and control means that is compliant with an open protocol. Therefore, this air conditioning monitoring and control system is capable of performing manufacturer-private and precise monitoring and control of the air conditioners while enabling communication between the air conditioners and the monitoring control devices using an open protocol.

An air conditioning monitoring and control system according to a second aspect of the present invention is the air conditioning monitoring and control system according to the first aspect of the present invention, wherein the first air conditioning monitoring and control device and the second air conditioning monitoring and control device communicate with the air conditioners using a first communication protocol.

Here, the first air conditioning monitoring and control device and the second air conditioning monitoring and control device communicate with the air conditioners using the first communication protocol. Accordingly, this air conditioning monitoring and control system enables simplification of the communication function of the air conditioners.

An air conditioning monitoring and control system according to a third aspect of the present invention is the air conditioning monitoring and control system according to the second aspect of the present invention, wherein the air conditioning monitoring and control system further comprises a first monitoring panel and a second monitoring panel. The first monitoring panel is configured to monitor the air conditioners, and is connected to or built into the first air conditioning monitoring and control device. The second monitoring panel is configured to monitor the air conditioners, and is connected to or built into the second air conditioning monitoring and control device. In addition, the second air conditioning monitoring and control device further includes communication protocol conversion means. The communication protocol conversion means is capable of converting between the first communication protocol and a second communication protocol. The first monitoring panel communicates with the first air conditioning monitoring and control device using the first communication protocol. In addition, the second monitoring panel communicates with the second air conditioning monitoring and control device using the second communication protocol.

Here, the first monitoring panel is connected to or built into the first air conditioning monitoring and control device. In addition, the second monitoring panel is connected to or built into the second air conditioning monitoring and control device. The second air conditioning monitoring and control device further includes the communication protocol conversion means. The communication protocol conversion means is capable of converting between the first communication protocol and a second communication protocol. The first monitoring panel communicates with the first air conditioning monitoring and control device using the first communication protocol. In addition, the second monitoring panel communicates with second air conditioning monitoring and control device using the second communication protocol. Accordingly, this air conditioning monitoring and control system allows the user to monitor not only the air conditioning monitoring and control device compliant with a manufacturer-private protocol but also the air conditioning monitoring and control device compliant with an open protocol.

An air conditioning monitoring and control system according to a fourth aspect of the present invention is the air conditioning monitoring and control system according to the third aspect of the present invention, wherein the first communication protocol is a manufacturer-private protocol. In addition, the second communication protocol is an open protocol. Note that an "open protocol" here refers to LonWorks protocol, BACnet protocol (A Data Communication Protocol for Building Automation and Control Networks: ISO16484-5, building management system communication protocols that are currently undergoing standardization), and the like.

Here, the first communication protocol is a manufacturer-private protocol. In addition, the second communication protocol is an open protocol. Accordingly, air conditioners compliant with a manufacturer-private protocol can be easily connected to air conditioners compliant with an open protocol, without requiring design changes.

An air conditioning monitoring and control system according to a fifth aspect of the present invention is the air conditioning monitoring and control system according to any one of the first through the fourth aspects of the present invention, wherein the first communication line and the second communication line are the same communication line.

Here, the first communication line and the second communication line are the same communication line. Accordingly, the wiring for the air conditioning monitoring and control system can be easily installed.

An air conditioning monitoring and control system according to a sixth aspect of the present invention is the air conditioning monitoring and control system according to any one of the first through the fifth aspects of the present invention, wherein the first monitoring and control means is capable of performing at least one type of control with respect to the air conditioners. In addition, at least one of the first air conditioning monitoring and control device and the second air conditioning monitoring and control device further includes control selection means. The control selection means allows the user to select to enable/disable one type of control when the first monitoring and control means is capable of performing one type of control, or each of at least two types of control when the first monitoring and control means is capable of performing two or more types of control.

Here, with the control selection means, it is possible to select to enable/disable one type of control or each of at least two types of control, depending on the number of types of control that the first monitoring and control means is capable of performing. Accordingly, this air conditioning monitoring and control system can avoid user confusion and prevent the occurrence of problems in controlling the air conditioners.

An air conditioning monitoring and control system according to a seventh aspect of the present invention is the air conditioning monitoring and control system according to the sixth aspect of the present invention, wherein the control performed by the first monitoring and control means includes at least one of forcible thermo OFF control and scheduled operation control of the air conditioners.

Here, the control includes at least one of the forcible thermo OFF control and the scheduled operation control of the air conditioners. Accordingly, this air conditioning monitoring and control system can avoid user confusion regarding the schedule of operation and prevent the occurrence of problems in energy saving control and demand control of the air conditioners.

Effect of the Invention

The air conditioning monitoring and control system according to the first aspect of the present invention is capable of performing manufacturer-private and precise monitoring and control of the air conditioners, while enabling communication between the air conditioners and the monitoring control devices using an open protocol.

The air conditioning monitoring and control system according to the second aspect of the present invention enables simplification of the communication function of the air conditioners.

The air conditioning monitoring and control system according to the third aspect of the present invention allows the user to monitor not only the air conditioning monitoring and control device compliant with a manufacturer-private protocol but also the air conditioning monitoring and control device compliant with an open protocol.

The air conditioning monitoring and control system according to the fourth aspect of the present invention enables easy connection between the air conditioners compliant with a manufacturer-private protocol and the air conditioners compliant with an open protocol, without requiring design changes.

The air conditioning monitoring and control system according to the fifth aspect of the present invention enables easy wiring installation.

The air conditioning monitoring and control system according to the sixth aspect of the present invention can avoid user confusion and prevent the occurrence of problems in controlling the air conditioners.

The air conditioning monitoring and control system according to the seventh aspect of the present invention can avoid user confusion regarding the schedule of operation and prevent the occurrence of problems in energy saving control and demand control of the air conditioners.

BRIEF DESCRIPTION OF THE DRAWINGS

FIG. 2 is a table (1) showing the functional comparison between a manufacturer-private protocol air conditioning controller and an open protocol air conditioning controller in a single controller system and a multiple controller system.

FIG. 3 is a table (2) showing the functional comparison between the manufacturer-private protocol air conditioning controller and the open protocol air conditioning controller in the single controller system and the multiple controller system.

FIG. 4(*a*) is a function block diagram of the manufacturer-private protocol air conditioning controller, and FIG. 4(*b*) is a function block of the open protocol air conditioning controller.

DETAILED DESCRIPTION OF THE INVENTION

Figure 1:
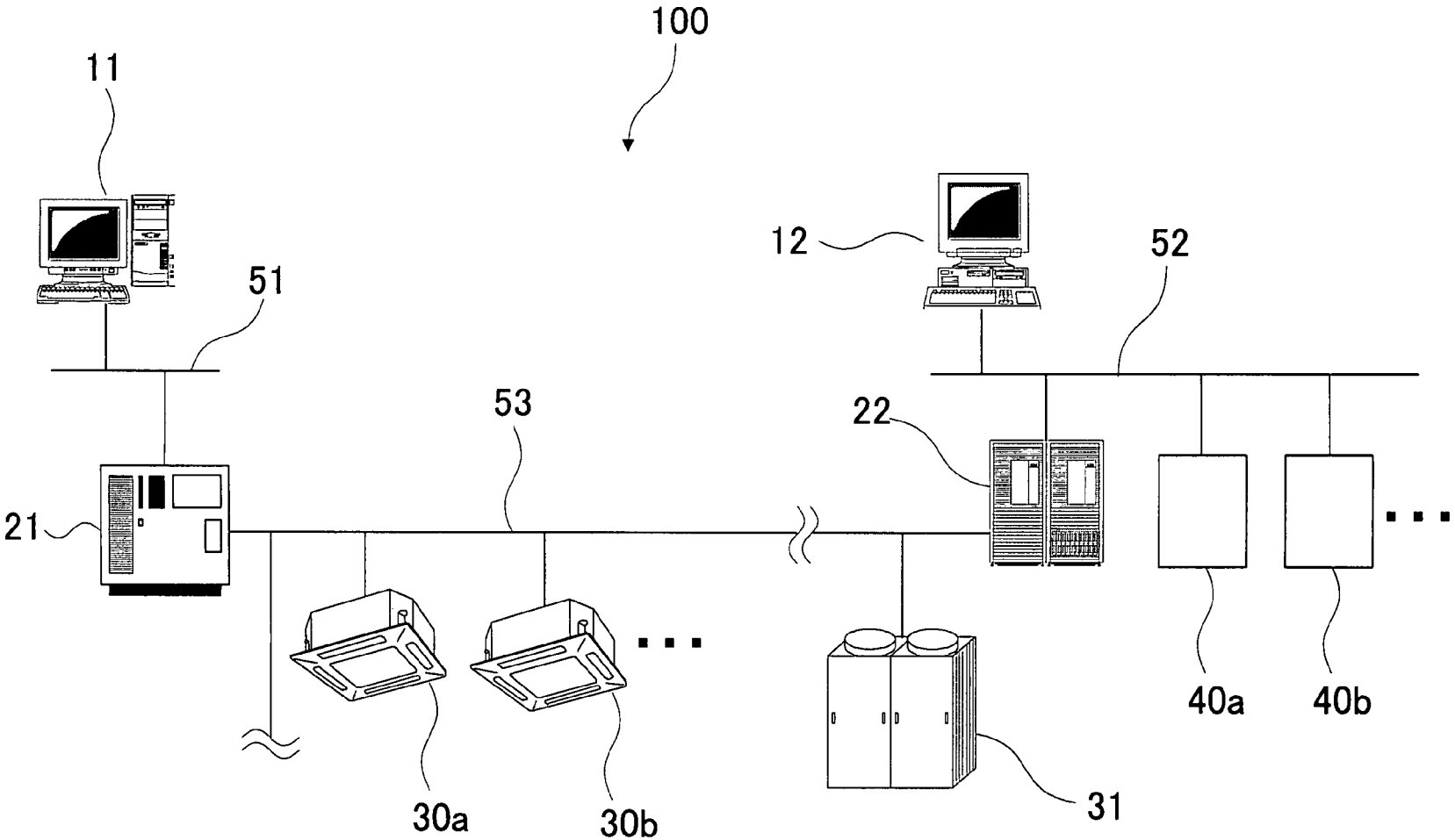
FIG. 1 is an overall configuration of an air conditioning monitoring and control system.

Configuration of the Air Conditioning Monitoring and Control System

FIG. 1 illustrates an air conditioning monitoring and control system according to an embodiment of the present invention.

As shown in FIG. 1, this air conditioning monitoring and control system 100 mainly comprises air conditioner indoor units 30*a*, 30*b* . . . , an air conditioner outdoor unit 31, a manufacturer-private protocol air conditioning controller 21, an open protocol air conditioning controller 22, a manufacturer-private protocol monitoring PC 11, an open protocol monitoring PC 12, and subsystems 40*a*, 40*b* . . . including open protocol devices (for example, lighting equipment, security equipment, disaster prevention equipment, etc.).

<Connection Topology of the Air Conditioning Monitoring and Control System>

The air conditioner indoor units 30*a*, 30*b* . . . and the air conditioner outdoor unit 31 are communicatively connected to the manufacturer-private protocol air conditioning controller 21 and the open protocol air conditioning controller 22 via a first communication line 53. The manufacturer-private protocol air conditioning controller 21 communicates with the manufacturer-private protocol monitoring PC 11 via a second communication line 51. The open protocol air conditioning controller 22 communicates with the open protocol monitoring PC 12 via a third communication line 52. In addition, the subsystems 40*a*, 40*b* . . . including the open protocol devices are also communicatively connected to the open protocol monitoring PC 12 via the third communication line 52.

<Components of the Air conditioning Monitoring and Control System>

(1) Air Conditioner Indoor Unit and Outdoor Unit

The air conditioner indoor units 30*a*, 30*b* . . . and the air conditioner outdoor unit 31 are mutually connected via refrigerant piping (not shown). The indoor units 30*a*, 30*b* . . . cool or heat the space around the indoor units 30*a*, 30*b* . . . by taking in air and cooling or heating the air using a refrigerant that is supplied from the outdoor unit 31 through the refrigerant piping. Note that these indoor units 30*a*, 30*b* . . . and the outdoor unit 31 are compliant with a manufacturer-private protocol.

(2) Manufacture-private Protocol Air Conditioning Controller

The manufacturer-private protocol air conditioning controller 21 has a function of monitoring the conditions of the indoor units 30*a*, 30*b* . . . and the outdoor unit 31 and ambient conditions (temperature, humidity, air cleanliness, etc.) and also has a function of controlling the indoor units 30*a*, 30*b* . . . and the outdoor unit 31. As shown in FIG. 4(*a*), this manufacturer-private protocol air conditioning controller 21 mainly comprises a control unit 21*a*, a memory unit 21*c*, and a communication unit 21*b*. The memory unit 21*c* stores a monitoring and control program that controls the following functions: a status monitoring function (constituting a status monitoring section), a function of monitoring prohibition/permission setting of operation by remote controller (constituting a setting monitoring section), a function of monitoring start-up/shutdown failure (constituting a start-up/shutdown failure monitoring section), a function of monitoring continuous operation period (constituting a continuous operation period monitoring section), a function of monitoring conflicting status and warning (constituting a conflicting status and warning monitoring section), a function of monitoring upper and lower measurement limits (constituting a upper and lower measurement limits monitoring section), a function of starting up/shutting down and changing set values for each device individually (constituting a starting up/shutting down and changing set values section), a function of prohibiting/permitting operation by remote controller (constituting a prohibiting/permitting operation section), a function of registering device for maintenance (constituting a maintenance section), a schedule control function (constituting a schedule control section), a function of gang control (constituting a gang control section), a function of handling power failure and restoration (constituting a power failure and restoration control section), a forcible shutdown function (constituting a forcible shutdown section), a function of prohibiting integrated operation from low-order device (constituting a prohibiting integrated operation section), an energy saving control function (constituting an energy saving control section), a demand control function (constituting a demand control section), a function of counting total operation hours (constituting a total operation hours counting section), a function of counting total number of start-up/shutdown events (constituting a total start-up/shutdown events section), a function of preparing daily, monthly, annual reports (constituting a reports section), a trend report function (constituting a trend report section), a function of calculating energy consumption cost based on power allocation (constituting a calculating section), a NSC AIRNET function (constituting a NSC AIRNET section), and a function of predicting local malfunction (constituting a predicting local malfunction section) (see FIGS. 2 and 3). Note that among these functions, the following functions are functions that are unique to the manufacturer-private protocol air conditioning controller 21: the function of monitoring continuous operation period, the function of monitoring conflicting status and warning, the energy saving control function, the demand control function, the function of preparing daily, monthly, annual reports, and the function of predicting local malfunction. The memory unit 21*c* also stores monitoring data and the like which are transmitted from the indoor units 30*a*, 30*b* . . . and the outdoor unit 31. The control unit 21*a* executes the monitoring and control program mentioned above, and enables these various functions with respect to the indoor units 30*a*, 30*b* . . . and the outdoor unit 31. The communication unit 21*b* is compliant with a manufacturer-private protocol.

The status monitoring function is a function that measures and monitors the conditions of the indoor units 30*a*, 30*b* . . . and the outdoor unit 31 and ambient conditions of the indoor units 30*a*, 30*b* . . . and the outdoor unit 31 (temperature, humidity, etc.) from various sensors. The function of monitoring prohibition/permission setting of operation by remote controller is a function that monitors whether operation via local remote control (wired remote control, wireless remote control, etc.) is permitted or prohibited in each of the indoor units 30*a*, 30*b* . . . . This function is mainly used to check the relationship between the status of the indoor units 30*a*, 30*b* . . . and the control related functions of the air conditioning controllers 21 and 22. The function of monitoring start-up/shutdown failure is a function that notifies the user when the manufacturer-private protocol air conditioning controller 21 fails in the start-up/shutdown operations of the indoor units 30*a*, 30*b* . . . and the outdoor unit 31. The function of monitoring continuous operation period is a function that monitors continuous operation periods of the air conditioning system, the outdoor unit 31, the indoor units 30*a*, 30*b*, and the like. The function of monitoring conflicting status and warning determines errors in devices such as the indoor units 30*a*,

30*b* . . . and the outdoor unit 31, and issues a warning, when the expected status based on the control setting does not match the actual status. The function of monitoring upper and lower measurement limits is a function that monitors whether or not sensor values are within a predetermined range of acceptable values. The function of starting-up/shutting down and changing set values for each device individually is a function that can individually start-up/shutdown devices such as the indoor units 30*a*, 30*b* . . . and the outdoor unit 31, and can also individually change the setting values of devices such as the indoor units 30*a*, 30*b* . . . and the outdoor unit 31. The function of prohibiting/permitting operation by remote controller is a function that prohibits or permits the operation of each of the indoor units 30*a*, 30*b* . . . via local remote control (wired remote control, wireless remote control, etc.). The function of registering device for maintenance is a function that detects devices such as the indoor units 30*a*, 30*b* . . . and the outdoor unit 31, which are set to maintenance mode, and registers these devices on a maintenance list. The schedule control function is a function that specifies the operation time of devices such as the indoor units 30*a*, 30*b* . . . and the outdoor unit 31, and operates these devices according to the schedule. The function of gang control is a function that controls such that the indoor units 30*a*, 30*b* . . . are linked to other devices such as a fan for cooling with outside air and a damper for cooling with outside air, for example. The function of handling power failure and restoration is a function that determines what procedures will be used to recover the manufacturer-private protocol air conditioning controller 21 upon the restoration of power after power failure. The forcible shutdown function is a function that forcibly stops devices such as the indoor units 30*a*, 30*b* . . . and the outdoor unit 31, when a predetermined condition is reached. The function of prohibiting integrated operation from low-order device is a function that, when an integrated control unit has a hierarchical structure, prohibits operation of the air conditioners from a low-order integrated device in the hierarchical structure and permits direct operation of the air conditioners from an integrated host device in the hierarchical structure. The energy saving control function is a function that operates devices such as the indoor units 30*a*, 30*b* . . . and the outdoor unit 31 in energy saving mode, based on the air conditioning load in the building and meteorological conditions. The demand control function is a function that estimates the amount of energy that may be used in a 30 minutes basis and controls operation of devices such as the indoor units 30*a*, 30*b* . . . and the outdoor unit 31, so that the amount of energy used will not exceed an upper limit. The function of counting total operation hours is a function that counts the total number of hours of operation of devices such as the air conditioning system, the outdoor unit 31, and the indoor units 30*a*, 30*b*. The function of counting total number of start-up/shutdown events is a function that counts the total number of times in which devices such as the outdoor unit 31 and the indoor units 30*a*, 30*b* are started up and shut down. The function of preparing daily, monthly, annual reports is a function that compiles various data, in report format, including the operation hours, the number of start-up/shutdown events, the amount of power consumption, the achievement ratio of energy saving performance, and the number of error occurrences of the air conditioning system, the outdoor unit 31, and the indoor units 30*a*, 30*b* . . . on the daily, monthly, and annual basis. The trend report function is a function that notifies the user of relatively recent trends of the conditions of devices such as the indoor units 30*a*, 30*b* . . . and the outdoor unit 31. The function of calculating energy consumption cost based on power allocation is a function that allocates power consumption for each tenant in the building and determines the cost to collect from each tenant based on the allocated amount of power. The NSC AIRNET function is a function that transmits monitoring data from the air conditioning system, the outdoor unit 31, the indoor units 30*a*, 30*b*, and the like to a remote central control center. Accordingly, it will be possible to remotely monitor and control devices such as the indoor units 30*a*, 30*b* . . . and the outdoor unit 31. The function of predicting local malfunction is a function that notifies the user when the conditions of specific parts of devices such as the indoor units 30*a*, 30*b* . . . and the outdoor unit 31 reach a predetermined condition, and informs the user that these devices such as the indoor units 30*a*, 30*b* and outdoor unit 31 will malfunction or the specific parts will be worn out in the near future.

(3) Open Protocol Air Conditioning Controller

Same as the manufacturer-private protocol air conditioning controller 21, the open protocol air conditioning controller 22 has a function of monitoring the conditions of the indoor units 30*a*, 30*b* . . . and the outdoor unit 31 and ambient conditions (temperature, humidity, air cleanliness, etc.) and also has a function of controlling the indoor units 30*a*, 30*b* . . . and the outdoor unit 31. As shown in FIG. 4(*b*), this open protocol air conditioning controller 22 mainly comprises a control unit 22*a*, a memory unit 22*c*, a communication unit 22*b*. The memory unit 22*c* stores a monitoring and control program that controls the following functions: the status monitoring function, the function of monitoring prohibition/permission setting of operation by remote controller, a function of monitoring forced thermostat OFF state, a function of forcibly setting thermostat OFF, the function of monitoring start-up/shutdown failure, function of monitoring upper and lower measurement limits, the function of starting up/shutting down and changing set values for each device individually, the function of prohibiting/permitting operation by remote controller, the function of registering device for maintenance, the schedule control function, the function of gang control, the function of handling power failure and restoration, the forcible shutdown function, the function of prohibiting integrated operation from low-order device, the function of counting total operation hours, the function of counting total number of start-up/shutdown events, the trend report function, the function of calculating energy consumption cost based on power allocation, and the NSC AIRNET function (see FIGS. 2 and 3). Among these functions, the function of monitoring forced thermostat OFF state and the function of forcibly setting thermostat OFF are functions that are unique to the open protocol air conditioning controller 22. This memory unit 22*c* also stores monitoring data and other data that are transmitted from the indoor units 30*a*, 30*b* . . . and the outdoor unit 31. The control unit 22*a* executes the monitoring and control program mentioned above, and enables these various functions with respect to the indoor units 30*a*, 30*b* . . . and the outdoor unit 31. The communication unit 22*c* has a protocol conversion unit 22*d* that converts between a manufacturer-private protocol and an open protocol (BAC net protocol), and that is compliant with both communication protocols.

As for the functions of this open protocol air conditioning controller 22, the following functions are the same as the functions of the manufacturer-private protocol air conditioning controller 21: the status monitoring function, the function of monitoring prohibition/permission setting of operation by remote controller, the function of monitoring start-up/shutdown failure, the function of monitoring upper and lower measurement limits, the function of starting up/shutting down and changing set values for each device individually, the function of prohibiting/permitting operation by remote controller, the function of registering device for maintenance, the schedule control function, the function of gang control, the function of handling power failure and restoration, the forcible shutdown function, the function of prohibiting integrated operation from low-order device, the function of counting total number of start-up/shutdown events, the trend report function, the function of calculating energy consumption cost based on power allocation, and the NSC AIRNET function. However, the targets of monitoring include not only devices such as the outdoor unit 31 and the indoor units 30*a*, 30*b* . . . but also the subsystems 40*a*, 40*b* . . . including devices compliant with an open protocol.

The function of monitoring forced thermostat OFF state is a function that monitors the operational state of a forced thermostat OFF setting in which the operation of the outdoor unit 31 and the indoor units 30*a*, 30*b* . . . is forcibly stopped when a predetermined condition is reached.

(4) Manufacture-Private Protocol Monitoring PC

The manufacturer-private protocol monitoring PC 11 stores various monitoring data transmitted from the manufacturer-private protocol air conditioning controller 21 in memory media such as a hard disk and the like (not shown). In addition, this manufacturer-private protocol monitoring PC 11 shows these monitoring data on a display. Further, this manufacturer-private protocol monitoring PC 11 is capable of changing status values and control values that are set in the manufacturer-private protocol air conditioning controller 21. Note that this manufacturer-private protocol monitoring PC 11 is compliant with a manufacturer-private protocol.

(5) Open Protocol Monitoring PC

The open protocol monitoring PC 12 stores various monitoring data transmitted from the open protocol air conditioning controller 22 in memory media such as a hard disk and the like (not shown). In addition, this open protocol monitoring PC 12 shows these monitoring data on a display. In addition, this open protocol monitoring PC 12 is capable of changing status values and control values that are set in the open protocol air conditioning controller 22. Note that this open protocol monitoring PC 12 is compliant with an open protocol.

(6) Subsystem Comprising Open Protocol Devices

The subsystems 40*a*, 40*b* . . . including the open protocol devices are subsystems that comprise devices such as lighting equipment, security equipment, disaster prevention equipment. Note that the subsystems 40*a*, 40*b* . . . including the open protocol devices are compliant with an open protocol.

<Function of Selecting Monitoring and Control in the Air Conditioning Monitoring and Control System>

The manufacturer-private protocol air conditioning controller 21 and the open protocol air conditioning controller 22 are provided with a function of selecting monitoring and control, which is a function that allows the user to select to enable or disable each function. By using this function of selecting monitoring and control, the user can adjust the relationship between the manufacturer-private protocol air conditioning controller 21 and the open protocol air conditioning controller 22 in terms of monitoring and control with respect to the indoor units 30*a*, 30*b* . . . and the outdoor unit 31. Examples of which functions are preferably selected will now be described.

(1) Monitoring Related Functions

With this air conditioning monitoring and control system 100, as shown in the right column of the table in FIG. 2, among the monitoring related functions of the open protocol air conditioning controller 22, the function of monitoring prohibition/permission setting of operation by remote controller is set to be disabled. This is because the manufacturer-private protocol air conditioning controller 21 is given a higher priority that is determined by the central address than the open protocol air conditioning controller 22. Although the status monitoring function, the function of monitoring start-up/shutdown failure and the function of monitoring upper and lower measurement limits are set to be enabled in both the manufacturer-private protocol air conditioning controller 21 and the open protocol air conditioning controller 22, it is possible to set these functions to be enabled in only one of the air conditioning controllers 21 and 22.

(2) Operation Related Functions

With this air conditioning monitoring and control system 100, as shown in the right column of the table in FIG. 2, among the operation related functions of the open protocol air conditioning controller 22, the function of prohibiting/permitting operation by remote controller and the function of forcibly setting thermostat OFF are set to be disabled. This is because when the forced thermo OFF state is released in the open protocol air conditioning controller 22, it will disturb the energy saving control function and the demand control function of the manufacturer-private protocol air conditioning controller 21. Although the function of starting up/shutting down and changing set values for each device individually and the function of registering device for maintenance can be enabled in both the manufacturer-private protocol air conditioning controller 21 and the open protocol air conditioning controller 22, it is possible to set these functions to be enabled in only one of the air conditioning controllers 21 and 22.

(3) Control Related Functions

With this air conditioning monitoring and control system 100, as shown in the right column of the table in FIG. 3, among the control related functions, the schedule control function, the function of gang control, the function of handling power failure and restoration, and the forcible shutdown function of the open protocol air conditioning controller 22 are set to be disabled. Alternatively, it may be the case that the schedule control function, the function of gang control, the function of handling power failure and restoration, and the forcible shutdown function of the manufacturer-private protocol air conditioning controller 21 are set to be disabled. Note that the user can optionally choose either case. It is technically possible to enable the schedule control function in both the air conditioning controllers 21 and 22. However, in order to avoid user confusion, the schedule control function in one of the air conditioning controllers 21 and 22 is set to be disabled. In addition, when the function of gang control is enabled in both the air conditioning controllers 21 and 22, it may cause a loop in which a linking program is endlessly iterated between the air conditioning controllers 21 and 22, so that the function of gang control in one of the air conditioning controllers 21 and 22 is set to be disabled. In addition, the function of handling power failure and restoration is selected to be enabled in one of the air conditioning controllers 21 and 22, depending on how the electric power is installed. In addition, the forcible shutdown function is selected to be enabled in one of the air conditioning controllers 21 and 22, depending on the source of a fire signal. In addition, the function of prohibiting integrated operation from low-order device is disabled in both the manufacturer-private protocol air conditioning controller 21 and the open protocol air conditioning controller 22.

(4) Data Management Related Function

With this air conditioning monitoring and control system 100, as shown in the right column of the table in FIG. 3, among all functions, the function of calculating energy consumption cost based on power allocation and the NSC AIRNET function of the open protocol air conditioning controller 22 are set to be disabled. Alternatively, it may be the case that the function of calculating energy consumption cost based on power allocation of the manufacturer-private protocol air conditioning controller 21 is set to be disabled. Note that the user can optionally choose either case. In addition, although the function of counting total operation hours, the function of counting total number of start-up/shutdown events, and the trend report function are set to be enabled in both the manufacturer-private protocol air conditioning controller 21 and the open protocol air conditioning controller 22, it is possible to set these functions to be enabled in only one of the air conditioning controllers 21 and 22.

<Characteristics of the Air Conditioning Monitoring and Control System>

(1)

With the air conditioning monitoring and control system 100 according to the present embodiment, both the manufacturer-private protocol air conditioning controller 21 and the open protocol air conditioning controller 22 have the following functions: the status monitoring function, the function of monitoring startup/shutdown failure, the function of monitoring upper and lower measurement limits, the function of starting up/shutting down and changing set values for each device individually, the function of registering device for maintenance, the function of counting total operation hours, the function of counting total number of start-up/shutdown events, and the trend report function. Further, only the manufacturer-private protocol air conditioning controller 21 has the following functions: the function of monitoring continuous operation period, the function of monitoring conflicting status and warning, the function of prohibiting/permitting operation by remote controller, the schedule control function, the function of gang control, the function of handling power failure and restoration, the forcible shutdown function, the energy saving control function, the demand control function, the function of preparing daily, monthly, annual reports, the function of calculating energy consumption cost based on power allocation, the NSC AIRNET function, and the function of predicting local malfunction. On the other hand, only the open protocol air conditioning controller 22 has the following functions: the function of monitoring forced thermostat OFF state and the function of forcibly setting thermostat OFF. In addition, the manufacturer-private protocol air conditioning controller 21 is compliant with a manufacturer-private protocol, whereas the open protocol air conditioning controller 22 is compliant with an open protocol. Therefore, the air conditioning monitoring and control system 100 enables functions compliant with a manufacturer-private protocol, i.e., the function of monitoring continuous operation period, the function of monitoring conflicting status and warning, the energy saving control function, the demand control function, the function of preparing daily, monthly, annual reports, and the function of predicting local malfunction, while enabling communication between the indoor units 30*a*, 30*b* . . . and the air conditioning controllers 21 and 22 using an open protocol.

(2)

With the air conditioning monitoring and control system 100 according to the present embodiment, a communication protocol between the indoor units 30*a*, 30*b* . . . and the manufacturer-private protocol air conditioning controller 21 is the same communication protocol between the indoor units 30*a*, 30*b* . . . and the open protocol air conditioning controller 22. Therefore, the communication function of the indoor units 30*a*, 30*b* . . . can be simplified.

(3)

With the air conditioning monitoring and control system 100 according to the present embodiment, each of the indoor units 30*a*, 30*b* . . . communicates with the first communication line 53. Accordingly, the wiring for the air conditioning monitoring and control system 100 can be easily installed.

(4)

With the air conditioning monitoring and control system 100 according to the present embodiment, the manufacturer-private protocol air conditioning controller 21 is compliant with a manufacturer-private protocol. In addition, the open protocol air conditioning controller 22 is compliant with an open protocol. Accordingly, the manufacturer-private protocol air conditioning controller 21 can be connected to air conditioners compliant with a different manufacturer-private protocol. Similarly, the open protocol air conditioning controller 22 can be connected to the subsystems 40*a*, 40*b* . . . including the open protocol devices. Accordingly, it is possible to easily connect the air conditioners compliant with a manufacturer-private protocol to the air conditioners compliant with an open protocol, without requiring design changes.

(5)

With the air conditioning monitoring and control system 100 according to the present embodiment, the manufacturer-private protocol monitoring PC 11 is connected to the manufacturer-private protocol air conditioning controller 21. In addition, the open protocol monitoring PC 12 is connected to the open protocol air conditioning controller 22. Accordingly, it is possible to obtain, through the manufacturer-private protocol monitoring PC 11, the information that can be obtained only through specific functions of the manufacturer-private protocol air conditioning controller 21, i.e., the function of monitoring continuous operation period, the function of monitoring conflicting status and warning, the energy saving control function, the demand control function, the function of preparing daily, monthly, annual reports, and the function of predicting local malfunction. In addition, the information that can be obtained only through the function of monitoring forced thermostat OFF state of the open protocol air conditioning controller 22 can be monitored through the open protocol monitoring PC 12. Therefore, monitoring information of the air conditioners compliant with manufacturer-private protocol can be browsed, while monitoring information of the air conditioners compliant with an open protocol can be browsed collectively.

<Modification>

(A)

With the air conditioning monitoring and control system 100 according to the previous embodiment, the manufacturer-private protocol monitoring PC 11 communicates with the manufacturer-private protocol air conditioning controller 21 via the second communication line 51, however, the manufacturer-private protocol monitoring PC 11 may be installed in the manufacturer-private protocol air conditioning controller 21. In addition, similarly, the open protocol monitoring PC 12 may be installed in the open protocol air conditioning controller 22.

(B)

With the air conditioning monitoring and control system 100 according to the previous embodiment, the indoor units 30*a*, 30*b* . . . , the outdoor unit 31, the manufacturer-private protocol air conditioning controller 21, and the open protocol air conditioning controller 22 are communicatively connected each other via the same communication line, however, the manufacturer-private protocol air conditioning controller 21 and the open protocol air conditioning controller 22 may be communicatively connected to the indoor units 30*a*, 30*b* . . . and the outdoor unit 31 via a different communication line. In addition, in this case, a communication protocol between the manufacturer-private protocol air conditioning controller 21 and devices such as the indoor units 30*a*, 30*b* . . . and the outdoor unit 31 may be different from a communication protocol between the open protocol air conditioning controller 22 and devices such as the indoor units 30*a*, 30*b* . . . and the outdoor unit 31.

(C)

The air conditioning monitoring and control system 100 according to the previous embodiment is provided with the function of selecting monitoring and control. This function of selecting monitoring and control may be provided with a scheduling function. Specifically, if this function of selecting monitoring and control is provided with a scheduling function, a certain function may be performed, for example, from 8:00 to 12:00 by the manufacturer-private protocol air conditioning controller 21, and the same function will be performed, for example, from 12:00 to 18:00 by the open protocol air conditioning controller.

INDUSTRIAL APPLICABILITY

The present invention provides the air conditioning monitoring and control system which is capable of performing manufacturer-private and precise monitoring and control of air conditioners while enabling communication between air conditioners and air conditioning monitoring and control devices using an open protocol, and which consequently can be applied to monitoring systems such as building monitoring systems.

What is claimed is:

1. An air conditioning monitoring and control system, comprising:

an air conditioner;

a first air conditioning monitoring and control device communicating with the air conditioner using a first communication protocol, the first air conditioning monitoring and control device including a first monitoring and control program and a second monitoring and control program being configured to monitor and/or to control the air conditioner, the first monitoring and control program being configured to perform at least one type of control with respect to the air conditioner;

a second air conditioning monitoring and control device communicating with the air conditioner using the first communication protocol, the second air conditioning monitoring and control device including a program having the same features as the first monitoring and control program, a third monitoring and control program being configured to monitor and/or to control the air conditioner, and the first air conditioning monitoring and control device communicate with the air conditioner using a first communication protocol;

the second air conditioning monitoring and control device further includes a communication protocol conversion unit capable of converting between the first communication protocol and a second communication protocol;

the first monitoring panel is configured to communicate with the first air conditioning monitoring and control device using the first communication protocol, and the second monitoring panel is configured to communicate with the second air conditioning monitoring and control device using the second communication protocol;

a communication protocol conversion unit being capable of converting between the first communication protocol and a second communication protocol;

a first monitoring panel built into or connected via a first communication line to the first air conditioning monitoring and control device to monitor the air conditioner, the first monitoring panel being configured to communicate with the first air conditioning monitoring and control device using the first communication protocol; and a second monitoring panel built into or connected via a second communication line to the second air conditioning monitoring and control device to monitor the air conditioner, the second communication line being separate from the first communication line and separately connecting to the second air conditioning monitoring and control device, the second monitoring panel being configured to communicate with the second air conditioning monitoring and control device using the second communication protocol, at least one of the first air conditioning monitoring and control device and the second air conditioning monitoring and control device having a control selection program that allows a selection to enable or to disable the one type of control, or each of the at least two types of control where the first monitoring and control program is configured to perform two or more types of control.

2. The air conditioning monitoring and control system according to claim 1, wherein the first communication protocol is a manufacturer-private protocol, and the second communication protocol is an open protocol.

3. The air conditioning monitoring and control system according to claim 2, wherein the first and second air conditioning monitoring and control devices are connected to the air conditioner via the same communication line.

4. The air conditioning monitoring and control system according to claim 1, wherein the first and second air conditioning monitoring and control devices are connected to the air conditioner via the same communication line.

5. The air conditioning monitoring and control system according to claim 4, wherein each of the first and second air conditioning monitoring and control devices is directly connected to the air conditioner via the same communication line.

6. The air conditioning monitoring and control system according to claim 1, wherein the second monitoring and control program is unique to the first air conditioning monitoring and control device, and the third monitoring and control program is unique to the second air conditioning monitoring and control device.

* * * * *

UNITED STATES PATENT AND TRADEMARK OFFICE

CERTIFICATE OF CORRECTION

PATENT NO. : 7,752,856 B2
APPLICATION NO. : 10/586605
DATED : July 13, 2010
INVENTOR(S) : Kazuhito Senba et al.

It is certified that error appears in the above-identified patent and that said Letters Patent is hereby corrected as shown below:

Column 13, lines 61 to 65 should be deleted.

Column 14, lines 1 to 10 of claim 1 should be deleted.

Signed and Sealed this

Thirty-first Day of August, 2010

David J. Kappos

David J. Kappos
*Director of the United States Patent and Trademark Office*